US010400616B2

(12) United States Patent
Tuertscher et al.

(10) Patent No.: US 10,400,616 B2
(45) Date of Patent: Sep. 3, 2019

(54) TURBINE NOZZLE WITH IMPINGEMENT BAFFLE

(71) Applicant: General Electric Company, Schenectady, NY (US)

(72) Inventors: Michael Ray Tuertscher, Cincinnatio, OH (US); Darell Glenn Senile, Cincinnati, OH (US); Greg Phelps, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 881 days.

(21) Appl. No.: 14/906,054

(22) PCT Filed: Jun. 18, 2014

(86) PCT No.: PCT/US2014/042985
§ 371 (c)(1),
(2) Date: Jan. 19, 2016

(87) PCT Pub. No.: WO2015/009392
PCT Pub. Date: Jan. 22, 2015

(65) Prior Publication Data

US 2016/0153299 A1 Jun. 2, 2016

Related U.S. Application Data

(60) Provisional application No. 61/856,376, filed on Jul. 19, 2013.

(51) Int. Cl.
*F01D 9/04* (2006.01)
*F01D 25/12* (2006.01)
(Continued)

(52) U.S. Cl.
CPC ..... *F01D 9/047* (2013.01); *F01D 5/14* (2013.01); *F01D 5/186* (2013.01); *F01D 5/189* (2013.01);
(Continued)

(58) Field of Classification Search
CPC . F01D 5/14; F01D 5/186; F01D 5/188; F01D 5/189; F01D 5/28; F01D 9/041;
(Continued)

(56) References Cited

U.S. PATENT DOCUMENTS 3,867,068 A 2/1975 Corsmeier et al.
5,292,227 A * 3/1994 Czachor ..... F01D 25/162 415/142
(Continued)

FOREIGN PATENT DOCUMENTS

CN 1763352 A 4/2006
DE 2 127 454 A1 12/1971
(Continued)

OTHER PUBLICATIONS

Machine Translation and Notification of Reasons for Refusal issued in connection with corresponding JP Application No. 2016-527995 dated Apr. 17, 2018.
(Continued)

*Primary Examiner* — Justin D Seabe
*Assistant Examiner* — Alexander A White
(74) *Attorney, Agent, or Firm* — General Electric; Kristi Davidson

(57) ABSTRACT

A turbine nozzle apparatus includes: a vane extending between inner and outer bands, the interior of the vane being open and communicating with an aperture in the outer band, wherein the vane and the bands are part of a monolithic whole of low-ductility material; a metallic baffle inside the vane, the baffle having upper and lower ends and a periph-
(Continued)

eral wall including a plurality of impingement holes defining an interior space, closed off by an end wall at the lower end; and a metallic retainer having a body with a shape generally matching the shape of the aperture, the body bearing against the upper end of the impingement baffle and being connected to the outer band by a plurality of mechanical fasteners.

14 Claims, 7 Drawing Sheets

(51) Int. Cl.

| | |
|---|---|
| ***F01D 5/14*** | (2006.01) |
| ***F01D 5/18*** | (2006.01) |
| ***F01D 5/28*** | (2006.01) |
| ***F01D 11/00*** | (2006.01) |
| ***F01D 25/24*** | (2006.01) |

(52) U.S. Cl.
CPC ..... *F01D 5/28* (2013.01); *F01D 9/041* (2013.01); *F01D 9/042* (2013.01); *F01D 9/044* (2013.01); *F01D 11/005* (2013.01); *F01D 25/12* (2013.01); *F01D 25/246* (2013.01); *F05D 2220/30* (2013.01); *F05D 2240/128* (2013.01); *F05D 2240/57* (2013.01); *F05D 2240/80* (2013.01); *F05D 2260/201* (2013.01); *F05D 2260/202* (2013.01); *F05D 2260/30* (2013.01); *F05D 2300/10* (2013.01); *F05D 2300/518* (2013.01)

(58) Field of Classification Search
CPC ..... F01D 9/042; F01D 9/044; F01D 9/047; F01D 11/005; F01D 25/12; F01D 25/246; F05D 2220/30; F05D 2240/128; F05D 2240/57; F05D 2240/80; F05D 2260/201; F05D 2260/202; F05D 2260/30; F05D 2300/10; F05D 2300/518
See application file for complete search history.

(56) References Cited

U.S. PATENT DOCUMENTS

| | | | | |
|---|---|---|---|---|
| 6,382,906 | B1 * | 5/2002 | Brassfield | F01D 5/18 415/115 |
| 6,464,456 | B2 * | 10/2002 | Darolia | F01D 5/3084 415/134 |
| 6,464,457 | B1 * | 10/2002 | Morgan | F01D 11/005 277/630 |
| 7,008,185 | B2 * | 3/2006 | Peterman | F01D 5/189 415/115 |
| 2006/0083613 | A1 | 4/2006 | Cunha et al. | |
| 2010/0068034 | A1 | 3/2010 | Schiavo et al. | |
| 2010/0129196 | A1 | 5/2010 | Johnston et al. | |
| 2010/0183429 | A1 * | 7/2010 | Liang | F01D 5/187 415/115 |

FOREIGN PATENT DOCUMENTS

| | | | |
|---|---|---|---|
| EP | 0974733 | A2 | 1/2000 |
| EP | 1156188 | A2 | 11/2001 |
| EP | 1452690 | A2 | 9/2004 |
| EP | 2466073 | A2 | 6/2012 |
| FR | 2976616 | A1 | 12/2012 |
| FR | 2979573 | A1 | 3/2013 |
| GB | 685769 | A | 1/1953 |
| JP | S50-26103 | A | 3/1975 |
| JP | 2000-282806 | A | 10/2000 |

OTHER PUBLICATIONS

Machine Translation and Decision to Grant issued in connection with corresponding JP Application No. 2016-527995 dated Jul. 20, 2018.
International Search Report and Written Opinion issued in connection with corresponding PCT application No. PCT/US2014/042985 dated Jan. 15, 2015.
Unofficial English Translation of Chinese Office Action issued in connection with corresponding CN Application No. 201480040992.9 dated Jun. 20, 2016.

* cited by examiner

TURBINE NOZZLE WITH IMPINGEMENT BAFFLE

BACKGROUND OF THE INVENTION

Embodiments of the present invention relate generally to gas turbine engines, and more particularly to turbine nozzles for such engines that incorporate a low-ductility material.

A typical gas turbine engine includes a turbomachinery core having a high pressure compressor, a combustor, and a high pressure turbine in serial flow relationship. The core is operable in a known manner to generate a primary gas flow. The high pressure turbine includes one or more stages which extract energy from the primary gas flow. Each stage comprises a stationary turbine nozzle followed by a downstream rotor carrying turbine blades. These components operate in an extremely high temperature environment, and must be cooled by air flow to ensure adequate service life. Typically, the air used for cooling is extracted (bled) from the compressor. Bleed air usage negatively impacts specific fuel consumption ("SFC") and should generally be minimized.

Metallic turbine structures can be replaced with materials having better high-temperature capabilities, such as ceramic matrix composites ("CMCs"). The density of CMCs is approximately one-third of that of conventional metallic superalloys used in the hot section of turbine engines, so by replacing the metallic alloy with CMC while maintaining the same part geometry, the weight of the component decreases, as well as the need for cooling air flow.

While CMC materials are useful in turbine components, it is difficult to use them for some mechanical elements such as cantilevered sections, springs, thin sections, and so forth. Therefore, a CMC component will typically need to be attached or connected to metallic components, such as baffles, spring elements, or seals.

This is complicated by the fact that CMC materials have relatively low tensile ductility or low strain to failure when compared with metals. Also, CMCs have a coefficient of thermal expansion ("CTE") approximately one-third that of superalloys, which means that a rigid joint between the two different materials induces large strains and stresses with changes in temperature, and clamping CMC and metal components together can introduce thermal stresses or open the clamp attachment. The allowable stress limits for CMCs are also lower than metal alloys which drives a need for simple and low stress design for CMC components. Finally, because of the different material compositions of CMC and metal components, traditional joining methods such as brazing and welding are not possible.

Accordingly, there is a need for an apparatus for combining CMC and other low-ductility components with metallic components that minimizes mechanical loads and thermal stresses on the CMC components.

BRIEF DESCRIPTION OF THE INVENTION

This need is addressed by embodiments of the present invention, which provides a turbine nozzle made of low-ductility material, and having a metallic impingement baffle attached thereto, and optionally including additional metallic sealing elements.

According to one aspect of an embodiment of the present invention, a turbine nozzle apparatus includes: an airfoil-shaped vane extending between an inner band and an outer band, wherein the interior of the vane is open and communicates with an airfoil-shaped aperture in the outer band, and wherein the vane and the bands are part of a monolithic whole constructed from a low-ductility material; a metallic baffle disposed inside the vane, the baffle having upper and lower ends and including a peripheral wall defining a hollow interior space, closed off by an end wall at the lower end, wherein a plurality of impingement holes are formed through the peripheral wall; and A metallic retainer having a body with an open ring shape generally matching the shape of the aperture, wherein the body bears against the upper end of the impingement baffle and is connected to the outer band by a plurality of mechanical fasteners.

According to another aspect of an embodiment of the present invention, a rabbet is formed around a central opening in the retainer, and an upper edge of the baffle is received in the rabbet According to another aspect of an embodiment of the present invention, a recess is formed in the outer band around the periphery of the aperture; and a baffle flange extends laterally outward from the periphery of the impingement baffle near the upper end and is received in the recess.

According to another aspect of an embodiment of the present invention, a baffle flange extends laterally outward from the periphery of the baffle near the upper end and is received in the recess; a peripheral groove is formed in a bottom face of the body, spaced laterally outside the rabbet; and a spring is disposed in the peripheral groove so as to exert a load in a radial direction between the retainer and the baffle flange.

According to another aspect of an embodiment of the present invention, the outer band includes a forward flange extending radially outward near its forward end, and an aft flange extending radially outward near its aft end; The body of the retainer includes an extension extending therefrom, with a radially-aligned retainer tab at its distal end, the retainer tab lying adjacent and parallel to the forward or aft flanges; and a retainer pin passes through the retainer tab and the forward or aft flange.

According to another aspect of an embodiment of the present invention, the outer band includes an aft flange extending radially outward near its aft end; an aft extension is disposed an aft end of the body, and includes a radially-aligned aft retainer tab at its distal end lying adjacent and parallel to the aft flange; and an aft retainer pin passes through the aft retainer tab and the aft flange;

According to another aspect of an embodiment of the present invention, an aft leaf seal is disposed between the aft flange and the aft retainer tab.

According to another aspect of an embodiment of the present invention, a V-shaped aft spring is disposed between the aft retainer tab and the aft leaf seal, biasing the aft leaf seal against the aft flange.

According to another aspect of an embodiment of the present invention, the outer band includes a forward flange extending radially outward near its forward end; a forward extension is disposed at a forward end of the body, and includes a radially-aligned forward retainer tab at its distal end, the forward retainer tab having two parallel legs, the forward flange being received in a space between the two legs; and a forward retainer pin passes through the forward retainer tab and the forward flange.

According to another aspect of an embodiment of the present invention, the outer band includes a seal lip positioned forward of the forward flange; and a forward leaf seal is disposed between the forward flange and the seal lip.

According to another aspect of an embodiment of the present invention, a forward spring is disposed between the forward retainer tab and the forward leaf seal, biasing the forward leaf seal against the seal lip.

According to another aspect of an embodiment of the present invention, an array of bumpers extend laterally outward from the peripheral wall of the impingement baffle.

According to another aspect of an embodiment of the present invention, the low-ductility material has a room temperature tensile ductility of no greater than about 1%.

According to another aspect of an embodiment of the present invention, the vane includes trailing edge slot.

According to another aspect of an embodiment of the present invention, the vane includes film cooling holes.

According to another aspect of an embodiment of the present invention, a plurality of vanes each having a baffle and a retainer are disposed between the inner and outer bands.

BRIEF DESCRIPTION OF THE DRAWINGS

Embodiments of the present invention may be best understood by reference to the following description taken in conjunction with the accompanying drawing figures in which.

DETAILED DESCRIPTION OF THE INVENTION

Figure 1:
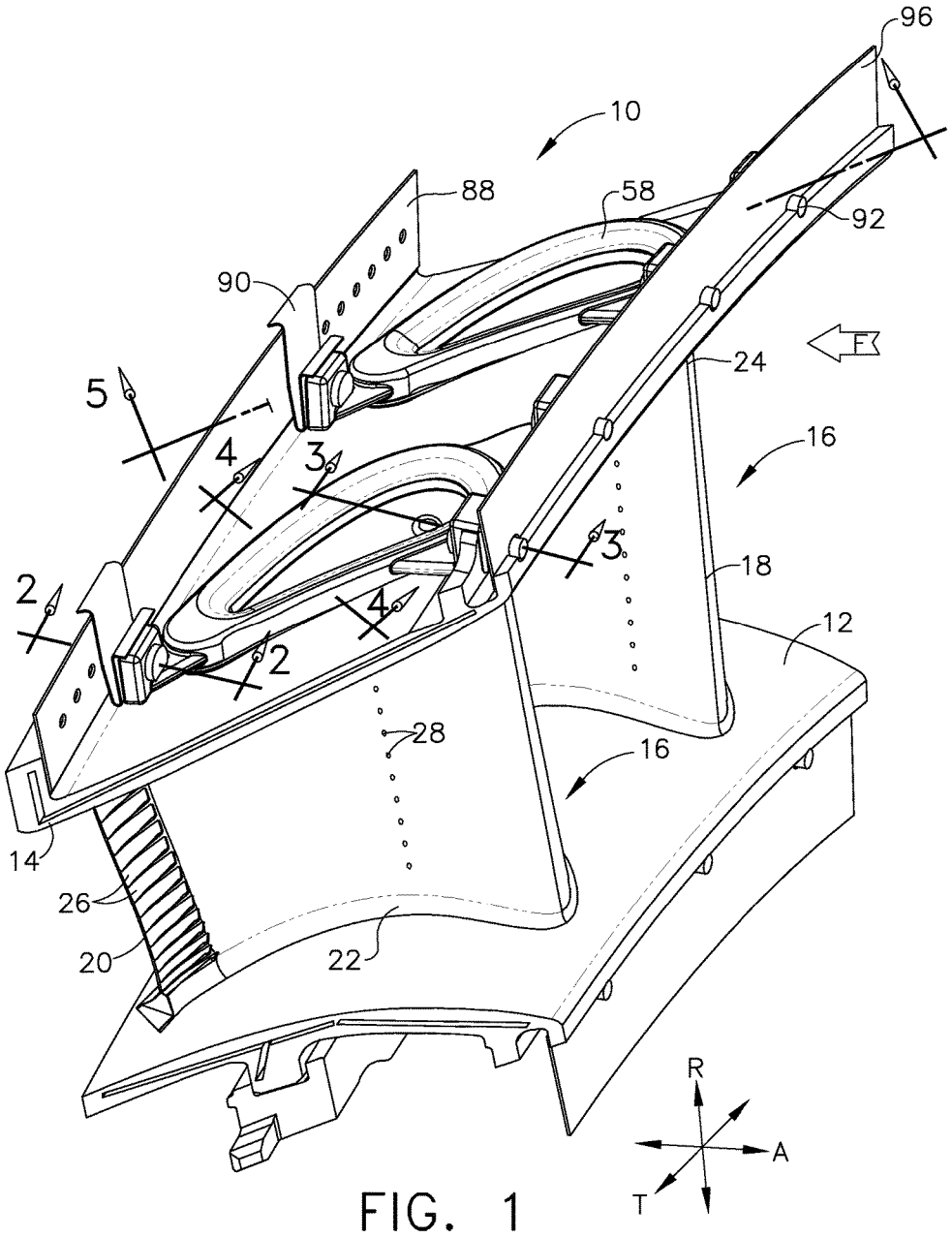
FIG. 1 is a schematic perspective view of a turbine nozzle segment for a gas turbine engine, constructed according to an aspect of the present invention.

Referring to the drawings wherein identical reference numerals denote the same elements throughout the various views, FIG. 1 depicts a turbine nozzle 10 constructed according to an aspect of the present invention. The turbine nozzle 10 is a stationary component forming part of a turbine section of a gas turbine engine. It will be understood that the turbine nozzle 10 would be mounted in a gas turbine engine upstream of a turbine rotor with a rotor disk carrying an array of airfoil-shaped turbine blades, the nozzle and the rotor defining one stage of the turbine. The primary function of the nozzle is to direct the combustion gas flow into the downstream turbine rotor stage.

A turbine is a known component of a gas turbine engine of a known type, and functions to extract energy from high-temperature, pressurized combustion gases from an upstream combustor (not shown) and to convert the energy to mechanical work, which is then used to drive a compressor, fan, shaft, or other mechanical load (not shown). The principles described herein are equally applicable to turbofan, turbojet and turboshaft engines, as well as turbine engines used for other vehicles or in stationary applications.

It is noted that, as used herein, the term "axial" or "longitudinal" refers to a direction parallel to an axis of rotation of a gas turbine engine, while "radial" refers to a direction perpendicular to the axial direction, and "tangential" or "circumferential" refers to a direction mutually perpendicular to the axial and tangential directions. (See arrows "A", "R", and "T" in FIG. 1). As used herein, the terms "forward" or "front" refer to a location relatively upstream in an air flow passing through or around a component, and the terms "aft" or "rear" refer to a location relatively downstream in an air flow passing through or around a component. The direction of this flow is shown by the arrow "F" in FIG. 1. These directional terms are used merely for convenience in description and do not require a particular orientation of the structures described thereby.

The turbine nozzle 10 includes an annular inner band 12 and an annular outer band 14, which define the inner and outer boundaries, respectively, of a hot gas flowpath through the turbine nozzle 10.

An array of airfoil-shaped turbine vanes (or simply "vanes") 16 is disposed between the inner band 12 and the outer band 14. Each vane 16 has opposed concave and convex sides extending between a leading edge 18 and a trailing edge 20, and extends between a root end 22 and a tip end 24. In the illustrated example, the nozzle 10 is a segment of a larger annular structure and includes two vanes 16. This configuration is commonly referred to as a "doublet." The principles of the present invention are equally applicable to a nozzle having a single vane, to segments having more than two vanes, or to or a complete nozzle ring structure.

The inner and outer bands 12 and 14 and the vanes 16 part of a monolithic whole constructed from a low-ductility, high-temperature-capable material. One example of a suitable material is a ceramic matrix composite (CMC) material of a known type. Generally, commercially available CMC materials include a ceramic type fiber for example silicon carbide (SiC), forms of which are coated with a compliant material such as boron nitride (BN). The fibers are carried in a ceramic type matrix, one form of which is SiC. Typically, CMC type materials have a room temperature tensile ductility of no greater than about 1%, herein used to define and mean a "low ductility material." Generally CMC-type materials have a room temperature tensile ductility in the range of about 0.4% to about 0.7%. This is compared with metals typically having a room temperature tensile ductility of at least about 5%, for example in the range of about 5% to about 15%.

The vanes 16 are hollow and incorporate cooling air exit features such as the illustrated trailing edge slots 26 and film cooling holes 28. Such exit features are known in the prior art and provide a flowpath for air to pass from the interior of the vanes 16 to their exterior. The inner end of each vane 16 is closed off by the inner band 12, and the interior of each vane 16 is open and communicates with an airfoil-shaped aperture 30 in the outer band 14. A recess 32 is formed around the periphery of each aperture 30 (see FIG. 3).

Figure 6:
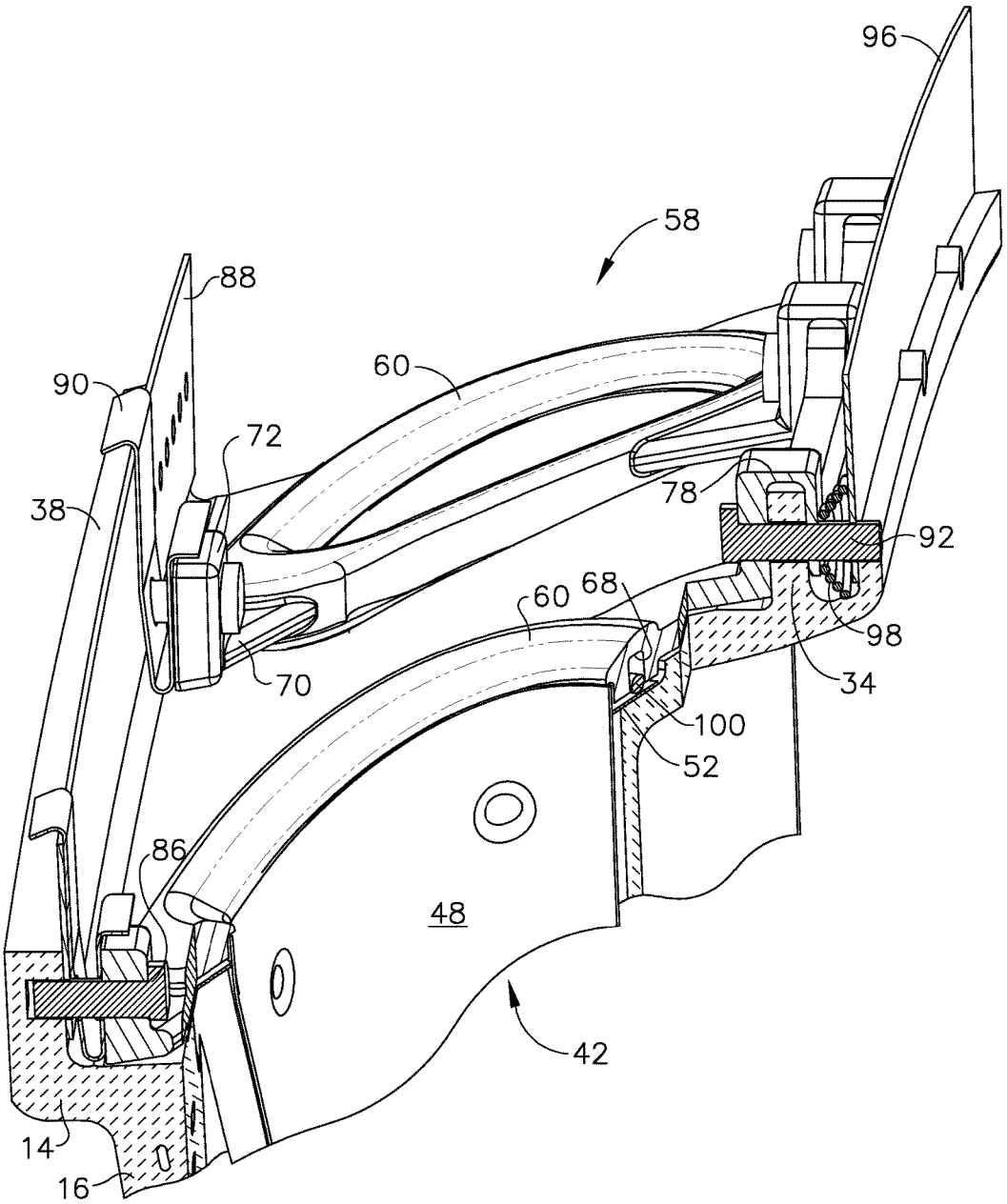
FIG. 6 is a view taken along lines 6-6 of FIG. 5.

Referring to FIG. 6, the outer band 14 includes a forward flange 34 extending radially outward near its forward end. A series of holes 36 (FIG. 3) which are generally axially aligned are spaced apart along the forward flange 34. The outer band 14 also includes an aft flange 38 extending radially outward near its aft end. A series of holes 40 (FIG. 2) which are generally axially aligned are spaced apart along the aft flange 38.

Figure 4:
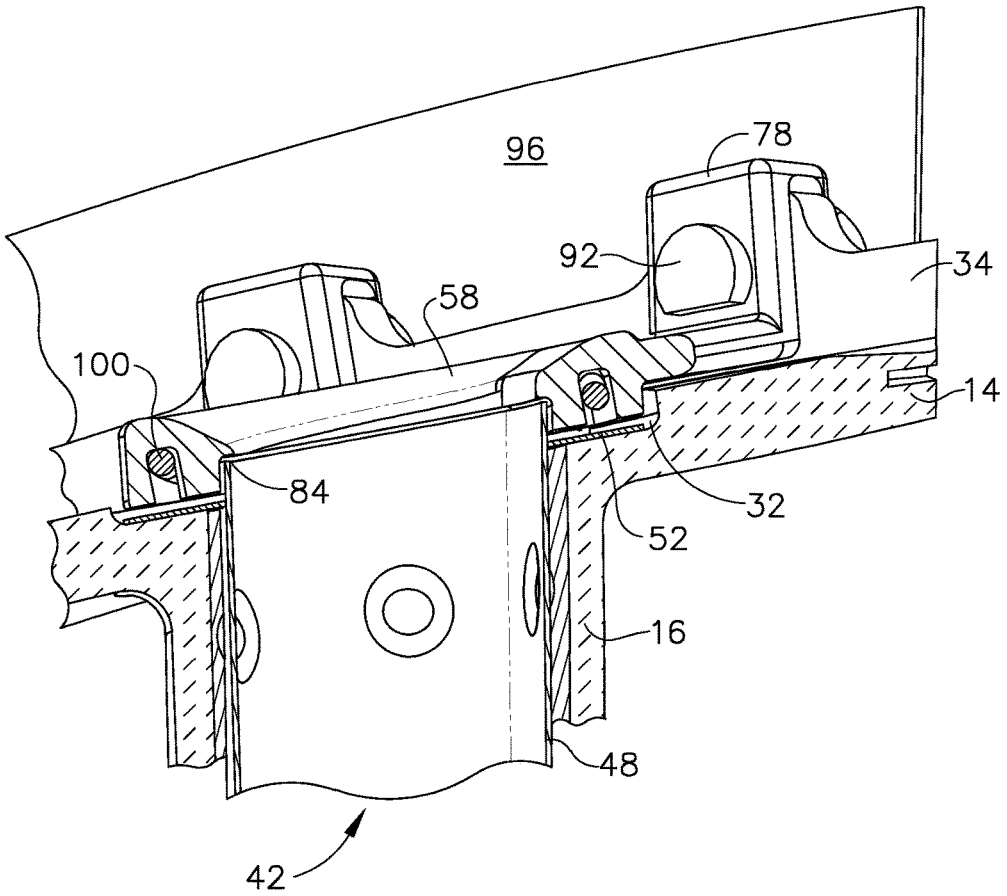
FIG. 4 is a sectional view taken along lines 4-4 of FIG. 1.
Figure 7:
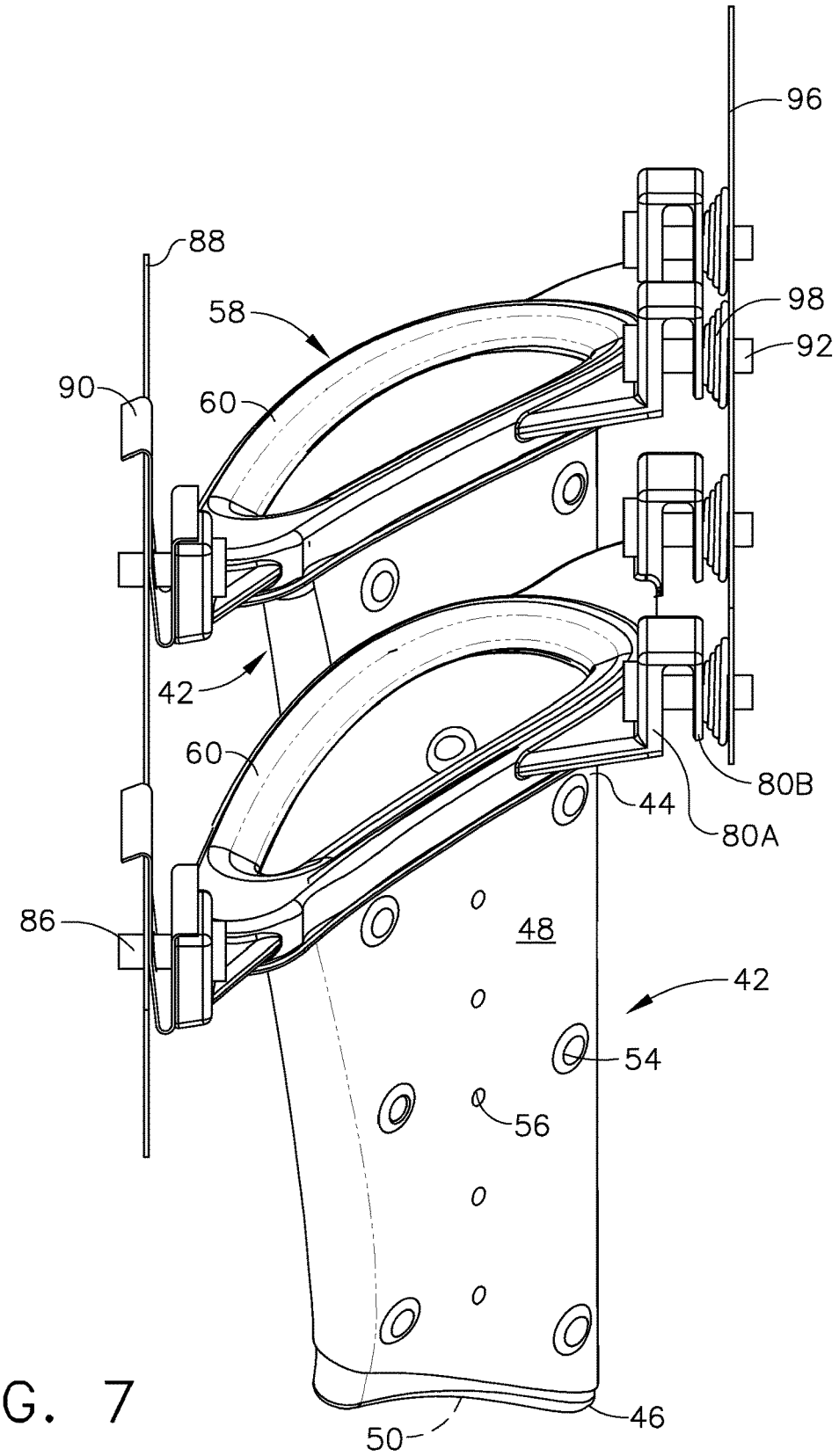
FIG. 7 is a side view of a pair of impingement baffles of the nozzle segment of FIG. 1, with the surrounding nozzle removed for clarity.

A metallic impingement baffle 42 with upper and lower ends 44 and 46 is received in the interior of each vane 16 (see FIG. 7). The impingement baffle 42 has a peripheral wall 48 defining a hollow interior space. An end wall 50 closes off the lower end 46. A baffle flange 52 (FIG. 4) extends laterally outward from the periphery of the impingement baffle 42 a short distance from the upper end 44. An array of protrusions or "bumpers" 54 extend laterally outward from the peripheral wall 48. A plurality of impingement holes 56 are formed through the peripheral wall 48.

The size and location of the impingement holes 56 will vary to suit a particular application, but one of ordinary skill in the art will recognize a distinction between "impingement holes" which are sized, shaped, and located so as to discharge a jet of cooling air against a nearby surface, and other type of cooling holes, such as film cooling holes.

Figure 8:
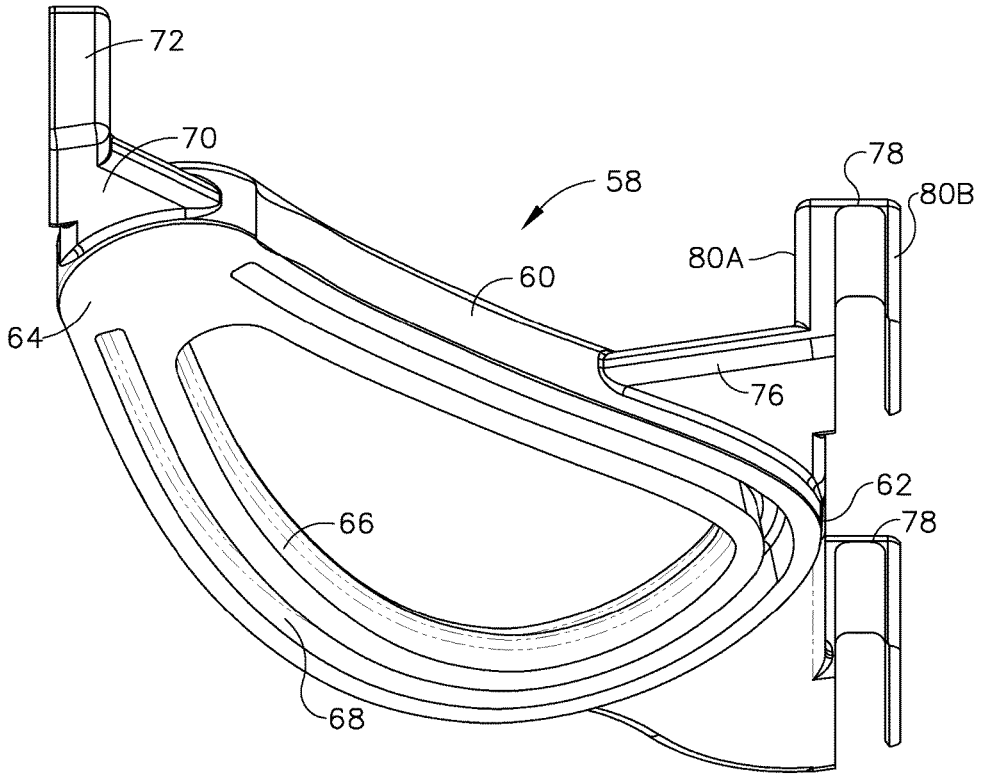
FIG. 8 is a bottom perspective view of a retainer of the nozzle segment of FIG. 1.

A metallic retainer 58 is provided for each impingement baffle 42. As seen in FIGS. 7 and 8, the retainer 58 has a body 60 with forward and aft ends 62 and 64. The body 60 is formed as an open ring with a shape generally matching the shape of the aperture 30. A lip or rabbet 66 is formed around a central opening in the retainer 58, and a peripheral groove 68 is formed in a bottom face of the body 60, spaced laterally outside the rabbet 66. An aft extension 70 is disposed at the aft end 64 of the body 60, and includes a radially-aligned aft retainer tab 72 at its distal end. The aft retainer tab 72 has an aft mounting hole 74 formed therein. A forward extension 76 is disposed at the forward end 62 of the body 60, and includes a pair of spaced-apart, radially-aligned forward retainer tabs 78 at its distal end. Each forward retainer tab 78 has two parallel legs 80A and 80B, with respective forward mounting holes 82A and 82B formed therein (see FIG. 3).

Figure 5:
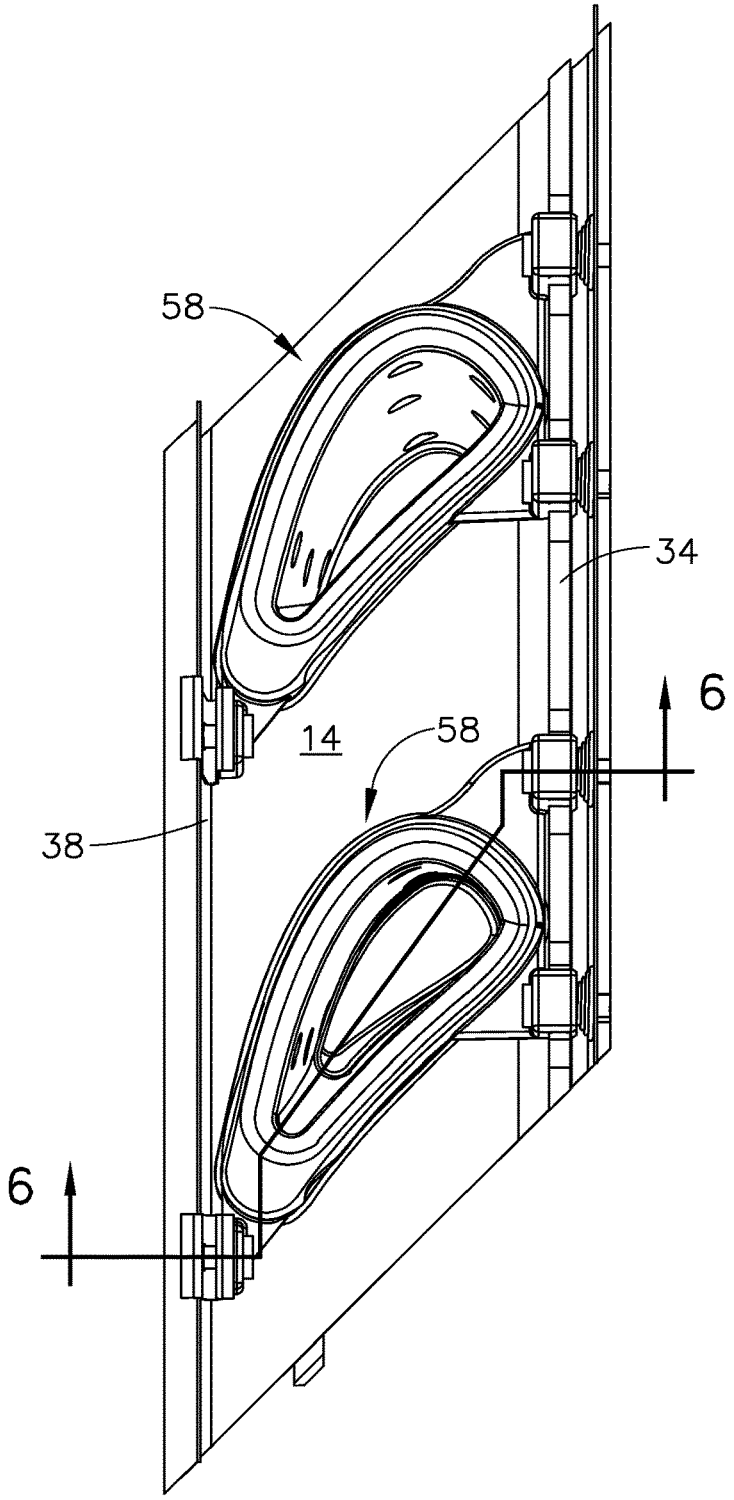
FIG. 5 is a top view of the turbine nozzle segment of FIG. 1.

FIGS. 5 and 6 depict the vane 16 and impingement baffle 42 in assembled condition. The impingement baffle 42 is received inside the hollow vane 16. The bumpers 54 ensure that a minimum lateral clearance exists between the peripheral wall 48 of the impingement baffle 42 and the wall of the vane 16. The baffle flange 52 rests on the recess 32, limiting the radial depth to which the impingement baffle 42 is inserted into the vane 16. The retainer 58 is positioned over the impingement baffle 42, so that the upper edge 84 of the impingement baffle 42 is received in the rabbet 66, with some lateral and radial clearance between the two components (see FIG. 3).

Figure 2:
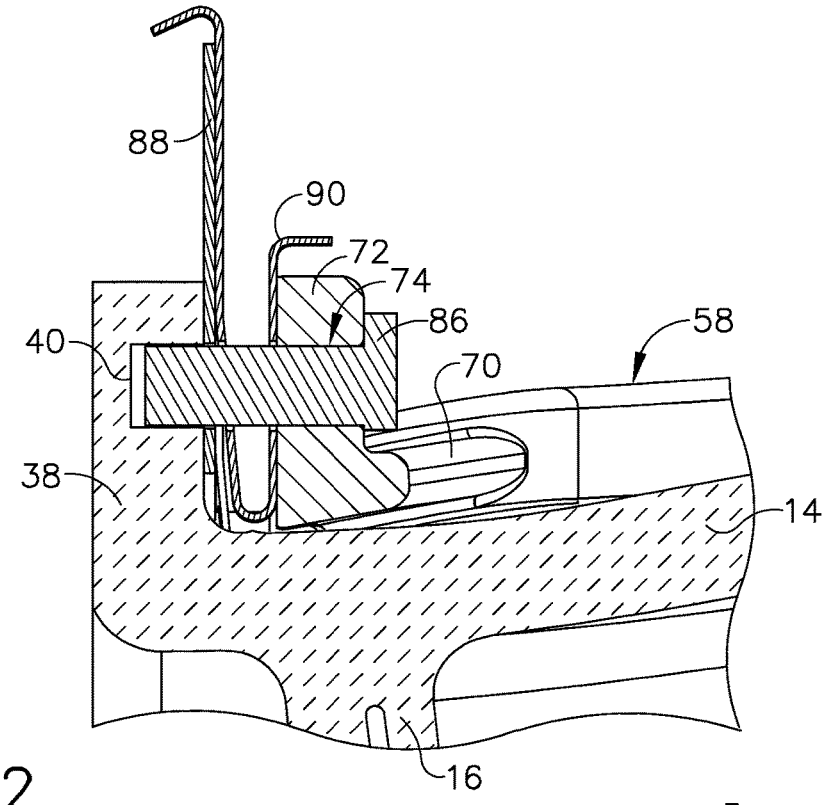
FIG. 2 is a sectional view taken along lines 2-2 of FIG. 1.

The retainer 58 overlies the impingement baffle 42, on the outside of the outer band 14. FIG. 2 shows the aft retainer tab 72 lying adjacent and parallel to the aft flange 38 of the outer band 14. An aft pin 86 with an enlarged head passes through the aft mounting hole 74 into one of the holes 40 in the aft flange 38. The aft pin 86 may be secured in place, for example by welding or brazing it to the aft retainer tab 72.

As an option, one or more sealing elements may be mounted between the aft flange 38 and the aft retainer tab 72. In the illustrated example, best seen in FIGS. 6 and 7, a laterally-elongated aft leaf seal 88 is positioned against the aft flange 38, and a V-shaped aft spring 90 is disposed between the aft retainer tab 72 and the aft leaf seal 88, biasing the aft leaf seal 88 against the aft flange 38. The aft leaf seal 88 and aft spring 90 are retained by the aft pins 86. The aft leaf seal 88 functions to reduce or prevent air leakage between the turbine nozzle 10 and surrounding engine components (not shown).

Figure 3:
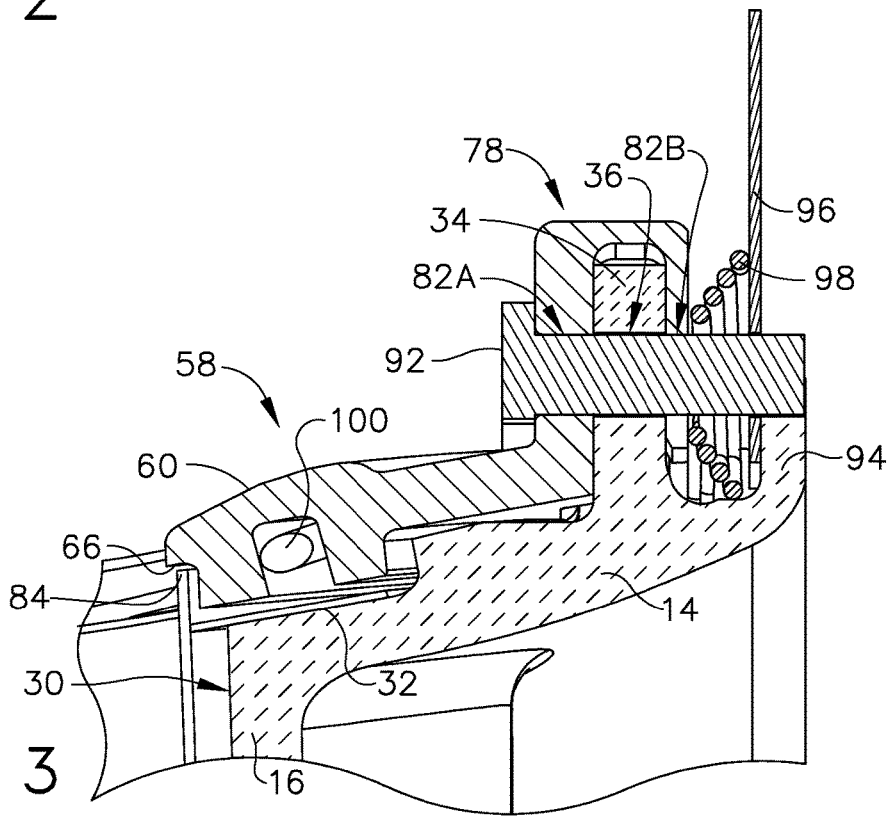
FIG. 3 is a sectional view taken along lines 3-3 of FIG. 1.

FIG. 3 shows one of the forward retainer tabs 78 engaging the forward flange 34 of the outer band 14. More specifically, the forward flange 34 is received in the space between the two legs 80A and 80B of the forward retainer tab 78. A forward pin 92 with an enlarged head passes through the forward mounting holes 82A and 82B, passing through one of the holes 36 in the forward flange 34. The forward pin 92 may be secured in place, for example by welding or brazing it to the forward retainer tab 78.

As an option, one or more sealing elements may be mounted between the forward flange 34 and the forward retainer tab 78. In the illustrated example, best seen in FIGS. 3, 6, and 7, the outer band 14 includes a seal lip 94 positioned slightly forward of the forward flange 34. A laterally-elongated forward leaf seal 96 is positioned against the seal lip 94, a and a coil-type forward spring 98 is disposed between the forward retainer tab 78 and the forward leaf seal 96, biasing the forward leaf seal 96 against the seal lip 94. The forward leaf seal 96 and forward spring 98 are retained by the forward pins 92. The forward leaf seal 96 functions to reduce or prevent air leakage between the turbine nozzle 10 and surrounding engine components (not shown).

Thus assembled, the retainer 58 is fixed in position relative to the vane 16. A distinct radial gap is present between the retainer 58 and the impingement baffle 42, best seen in FIG. 4.

As part of the assembly, a wave spring 100 which is C-shaped in plan view is positioned in the peripheral groove 68 (see FIG. 6). This spring 100 exerts a load in a radial direction between the retainer 58 and the baffle flange 52. Since the retainer 58 is fixed relative to the outer band 14, the action of the wave spring 100 forces the baffle flange 52 radially inward, against the recess 30 of the outer band 14. This arrangement keeps the impingement baffle 42 in position, and seals against air leakage between the impingement baffle 42 and the vane 16, while allowing for differential thermal expansion between the retainer 58 and the vane 16.

The turbine nozzle described above has several advantages compared to the prior art. The impingement baffle is held in place by the retainer despite temperature changes and the different coefficients of thermal expansion of the two materials. Furthermore, the same retainer is utilized to retain springs and leaf seals to a CMC component. By combining all of these features into a metal retainer, conventional metal joining procedures (i.e. tack welds) can be utilized The foregoing has described a turbine nozzle for a gas turbine engine. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A turbine nozzle apparatus comprising:

an airfoil-shaped vane extending between an inner band and an outer band, wherein the interior of the vane is open and communicates with an airfoil-shaped aperture in the outer band, and wherein the vane and the bands are part of a monolithic whole constructed from a low-ductility material;

a metallic baffle disposed inside the vane, the baffle having upper and lower ends and including a peripheral wall defining a hollow interior space, closed off by an end wall at the lower end, wherein a plurality of impingement holes are formed through the peripheral wall; and a metallic retainer having a body with an open ring shape generally matching the shape of the aperture, wherein the body bears against the upper end of the impingement baffle and is connected to the outer band by a plurality of mechanical fasteners, wherein a rabbet is formed around a central opening in the retainer, and an upper edge of the baffle is received in the rabbet.

2. The apparatus of claim 1 wherein:

the outer band includes a forward flange extending radially outward near its forward end, and an aft flange extending radially outward near its aft end;

the body of the retainer includes an extension extending therefrom, with a radially-aligned retainer tab at its distal end, the retainer tab lying adjacent and parallel to the forward or aft flanges; and a retainer pin passes through the retainer tab and the forward or aft flange.

3. The apparatus of claim 1 wherein:

the outer band includes an aft flange extending radially outward near its aft end;

an aft extension is disposed an aft end of the body, and includes a radially-aligned aft retainer tab at its distal end lying adjacent and parallel to the aft flange; and an aft retainer pin passes through the aft retainer tab and the aft flange.

4. The apparatus of claim 3 wherein an aft leaf seal is disposed between the aft flange and the aft retainer tab.

5. The apparatus of claim 4 wherein a V-shaped aft spring is disposed between the aft retainer tab and the aft leaf seal, biasing the aft leaf seal against the aft flange.

6. The apparatus of claim 1 wherein an array of bumpers extend laterally outward from the peripheral wall of the impingement baffle.

7. The apparatus of claim 1 wherein the low-ductility material has a room temperature tensile ductility of no greater than about 1%.

8. The apparatus of claim 1 wherein the vane includes a trailing edge slot.

9. The apparatus of claim 1 wherein the vane includes film cooling holes.

10. The apparatus of claim 1 wherein a plurality of vanes each having a baffle and a retainer are disposed between the inner and outer bands.

11. A turbine nozzle apparatus comprising:

an airfoil-shaped vane extending between an inner band and an outer band, wherein the interior of the vane is open and communicates with an airfoil-shaped aperture in the outer band, and wherein the vane and the bands are part of a monolithic whole constructed from a low-ductility material;

a metallic baffle disposed inside the vane, the baffle having upper and lower ends and including a peripheral wall defining a hollow interior space, closed off by an end wall at the lower end, wherein a plurality of impingement holes are formed through the peripheral wall; and a metallic retainer having a body with an open ring shape generally matching the shape of the aperture, wherein the body bears against the upper end of the impingement baffle and is connected to the outer band by a plurality of mechanical fasteners;

a recess formed in the outer band around the periphery of the aperture;

a baffle flange received in the recess and extending laterally outward from the periphery of the impingement baffle near the upper end;

a peripheral groove formed in a bottom face of the body, spaced laterally outside a rabbet; and a spring disposed in the peripheral groove so as to exert a load in a radial direction between the retainer and the baffle flange.

12. A turbine nozzle apparatus comprising:

an airfoil-shaped vane extending between an inner band and an outer band, the outer band includes a forward flange extending radially outward near its forward end, wherein the interior of the vane is open and communicates with an airfoil-shaped aperture in the outer band, and wherein the vane and the bands are part of a monolithic whole constructed from a low-ductility material;

a metallic baffle disposed inside the vane, the baffle having upper and lower ends and including a peripheral wall defining a hollow interior space, closed off by an end wall at the lower end, wherein a plurality of impingement holes are formed through the peripheral wall;

a metallic retainer having a body with an open ring shape generally matching the shape of the aperture, wherein the body bears against the upper end of the impingement baffle and is connected to the outer band by a plurality of mechanical fasteners;

a forward extension disposed at a forward end of the body, the forward extension having a radially-aligned forward retainer tab at its distal end, the forward retainer tab having two parallel legs, the forward flange being received in a space between the two legs; and a forward retainer pin passing through the forward retainer tab and the forward flange.

13. The apparatus of claim 12 wherein:

the outer band includes a seal lip positioned forward of the forward flange; and a forward leaf seal is disposed between the forward flange and the seal lip.

14. The apparatus of claim 13 wherein a forward spring is disposed between the forward retainer tab and the forward leaf seal, biasing the forward leaf seal against the seal lip.

* * * * *